US006786268B2

(12) United States Patent
Corey et al.

(10) Patent No.: US 6,786,268 B2
(45) Date of Patent: Sep. 7, 2004

(54) ACTUATOR DEVICE FOR VIEW THROUGH WINDOW COVERING

(75) Inventors: John A. Corey, Melrose, NY (US); Raymond Randall, New Hartford, NY (US); Richard D. Watkins, Lake Luzerne, NY (US)

(73) Assignee: Comfortex Corporation, Watervliet, NY (US)

( * ) Notice: Subject to any disclaimer, the term of this patent is extended or adjusted under 35 U.S.C. 154(b) by 0 days.

(21) Appl. No.: 10/264,479

(22) Filed: Oct. 3, 2002

(65) Prior Publication Data

US 2003/0127196 A1 Jul. 10, 2003

Related U.S. Application Data

(60) Provisional application No. 60/346,347, filed on Jan. 7, 2002.

(51) Int. Cl.[7] ..... E06B 9/06
(52) U.S. Cl. ..... 160/84.05; 160/176.1 R
(58) Field of Search ..... 160/84.05, 84.03, 160/84.01, 115, 178.3, 176.1 R, 177 R

(56) References Cited

U.S. PATENT DOCUMENTS

| | | | | |
|---|---|---|---|---|
| 2,786,521 A | | 3/1957 | Evans | |
| 4,450,027 A | | 5/1984 | Colson | |
| 5,680,891 A | * | 10/1997 | Prince | 160/84.05 |
| 5,733,632 A | | 3/1998 | Marusak | |
| 5,791,390 A | | 8/1998 | Watanabe | |
| 5,918,655 A | | 7/1999 | Corey | |
| 6,006,812 A | | 12/1999 | Corey | |
| 6,206,075 B1 | | 3/2001 | Prince et al. | |

FOREIGN PATENT DOCUMENTS

DE 35 29 418 C A1 4/1987

OTHER PUBLICATIONS

International Search Report No. PCT/US02/41375 dated May 8, 2003.
International Search Report No. PCT/US02/41375 dated Sep. 19, 2003.

* cited by examiner

*Primary Examiner*—Blair M. Johnson
(74) *Attorney, Agent, or Firm*—Rader, Fishman & Grauer PLLC

(57) ABSTRACT

An actuator device is provided for use in a view-through window covering having a plurality of cells. The actuator device includes at least one cooperating pair of control members including a first control member that engages an upper portion of each cell and a second control member that engages a lower portion of each cell. The cooperating pair of control members are engaged with the cells along a plane parallel to the plane of the window covering, whereby relative movement of the control members modifies the size of the space between the cells. The actuator device may also include an actuator mechanism selectively operable to create opposite movement of the first and second control members. A guide member may also be provided to transition the first and second control members from being aligned substantially perpendicular to the window covering plane to being aligned substantially parallel with the window covering plane.

42 Claims, 6 Drawing Sheets

ACTUATOR DEVICE FOR VIEW THROUGH WINDOW COVERING

RELATED APPLICATIONS

This application claims priority to U.S. provisional application 60/346,347 filed on Jan. 7, 2002, which is incorporated by reference in its entirety.

BACKGROUND OF THE INVENTION

1. Field of the Invention

The present invention generally relates to window coverings and treatments. More specifically, the present invention relates to an actuator device suitable for use with an adjustable view-through cellular shade or window covering.

2. Description of the Related Art

Partly in response to the limitations inherent in traditional window coverings like venetian blinds, fresh window coverings and treatments, such as multi-cellular shades, were developed and welcomed by consumers. In the broad sense, a cellular shade is a pleated window covering having a plurality of cells arranged adjacent to one another. The adjacent cells are bonded at their edges to form a complete sheet for the window covering. These multi-cellular shades provide significant insulating value, uniform light diffusion and a desirable aesthetic presentation, but they typically have no view-through capability. Unlike traditional venetian blinds, which provide easy modulatable view-through and light control by simply adjusting the orientation of the horizontally disposed slats or vanes, traditional multi-cellular shades are not capable of separating the plurality of cells, thus preventing a view-through option. Therefore, in order for a person to see through a window that is outfitted with a traditional multi-cellular shade, it is necessary to collectively raise and gather the plurality of cells, i.e., raise the entire window covering. However, raising the whole cellular window shade is laborious and time consuming.

In light of the advantages of venetian blind and multi-cellular window shades, a hybrid window covering was developed that provides the characteristics of both a venetian blind and a multi-cellular window covering. This hybrid window covering includes a plurality of cells arranged parallel to one another. Each cell has at least one side, and a joint unites adjacent sides of each cell. The adjacent sides are pivotable about the joint such that each cell is variably adjustable between a collapsed position and an expanded position. By collapsing and expanding the cells, the window covering can achieve adjustable light-control, modulatable view-through, light diffusion, and excellent insulation value, all in an aesthetically pleasing design.

Included in this hybrid window covering is a means for variably adjusting the cells between the collapsed position, where adjacent cells are separated, and the expanded positioned, where adjacent cells contact one another. The adjustment means typically includes a pair of cords that engage and actuate the cells between the collapsed and expanded positions. Due to the structure of the cells, the relative position of the cords in each pair is not fore-and-aft (i.e., perpendicular to the plane of the window covering), as in a conventional venetian blind, but rather is parallel to the plane of the window covering for central, balanced lifting and lowering of the upper and lower portions of each cell.

One limitation to positioning the cords along a common plane with the width of the cells is that the cords generally do not function properly with conventional head-rail mounted adjustment mechanisms. More specifically, twisting the cords from the fore-and-aft spacing in a conventional head-rail to a position substantially parallel with the window covering plane creates an uneven motion between the cords during adjustment. This uneven motion causes the cells' weight to be lifted or dropped during adjustment of the cells. Thus, the cells tend to jump away from the adjustment mechanism as the cells collapse and strongly resist or load the adjustment mechanism as the cells expand.

SUMMARY OF THE INVENTION

An actuator device is provided for use in a view-through window covering having a plurality of cells. The actuator device includes at least one cooperating pair of control members including a first control member that supports an upper portion of each cell and a second control member that supports a lower portion of each cell. The cooperating pair of control members support the cells along a plane parallel to the plane of the window covering. Relative movement of the control members modifies the size of the space between the cells.

The actuator device may also include an actuator mechanism selectively operable to create opposite movement of the first and second control members. A guide member may also be provided between the actuator mechanism and the control members to transition the control members from being aligned substantially perpendicular to the window covering plane to being aligned substantially parallel with the window covering plane.

Various additional aspects of this invention will become apparent to those skilled in the art from the following detailed description of the preferred embodiments, when read in light of the accompanying drawings.

DESCRIPTION OF THE PREFERRED EMBODIMENTS

Figure 3:
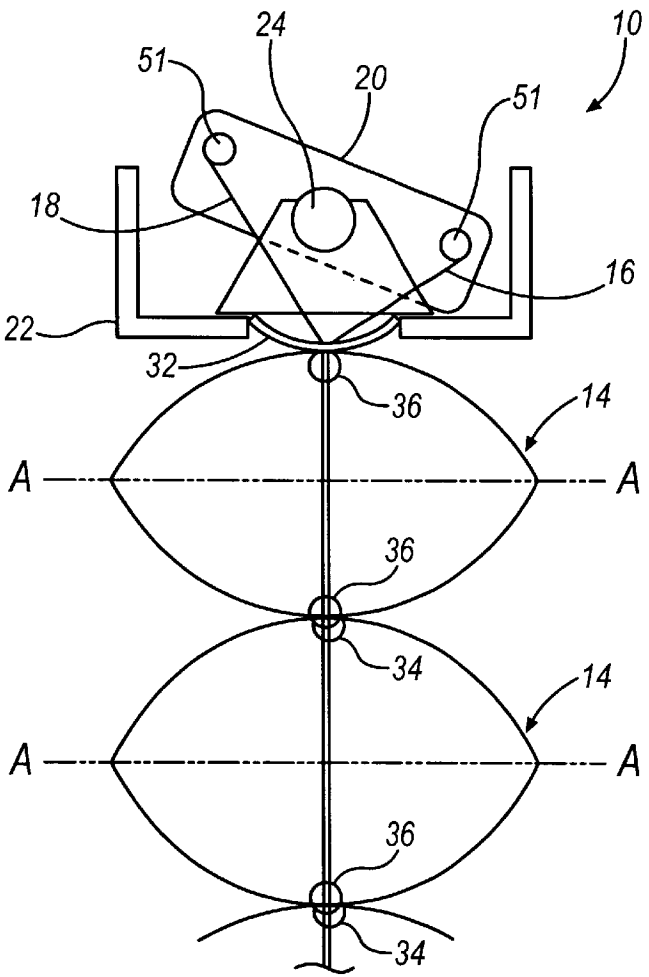
FIG. 3 is a side view of the window covering of FIG. 2, wherein the cells are arranged in a closed (expanded) position.
Figure 2:
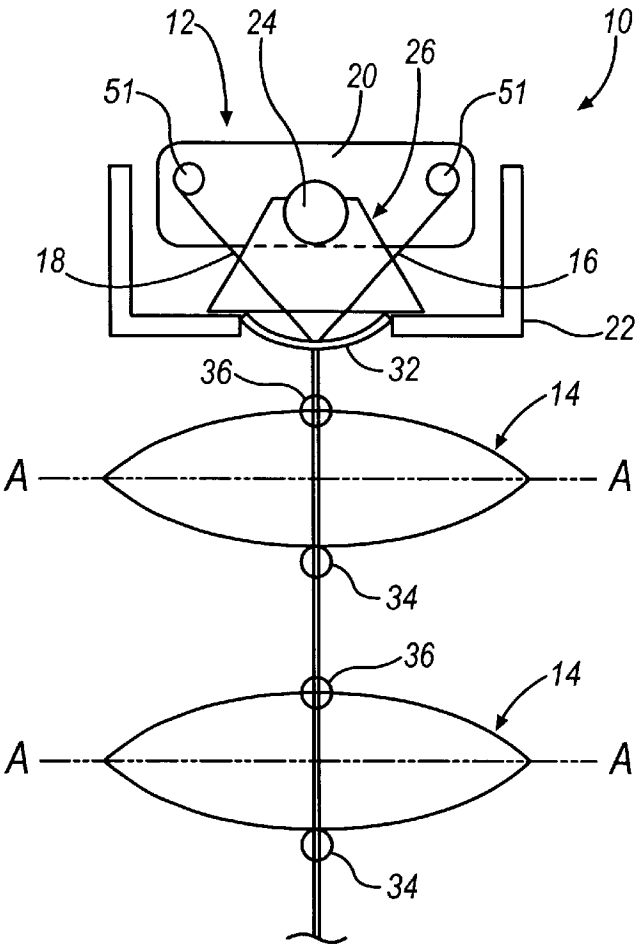
FIG. 2 is a side view of a window covering employing an actuator device according to an embodiment of the present invention, wherein a plurality of cells are arranged in an open (collapsed) position.

Referring now to the drawings, various embodiments of the present invention are described in detail. Referring to FIG. 2, an exemplary window covering is shown within which an actuator device 12 according to the principles of the present invention may be advantageously employed. Window covering 10 may include a plurality of horizontally disposed elongated cells 14, all of which are preferably arranged parallel to one another. Each cell 14 is adapted to be expanded and collapsed so as to provide variable light control and see-through capability for window covering 10. FIG. 3 depicts cells 14 in the expanded position, wherein adjacent cells 14 are in contact with one another, while FIG. 2 depicts cells 14 in a partly collapsed position, wherein adjacent cells 14 are separated from one another. The design and configuration of window covering 10 is by way of example only and is not intended to limit the scope of the invention as claimed. Accordingly, the components of the exemplary window covering 10, more particularly cells 14, can be arranged and designed in a wide variety of different configurations.

Figure 1:
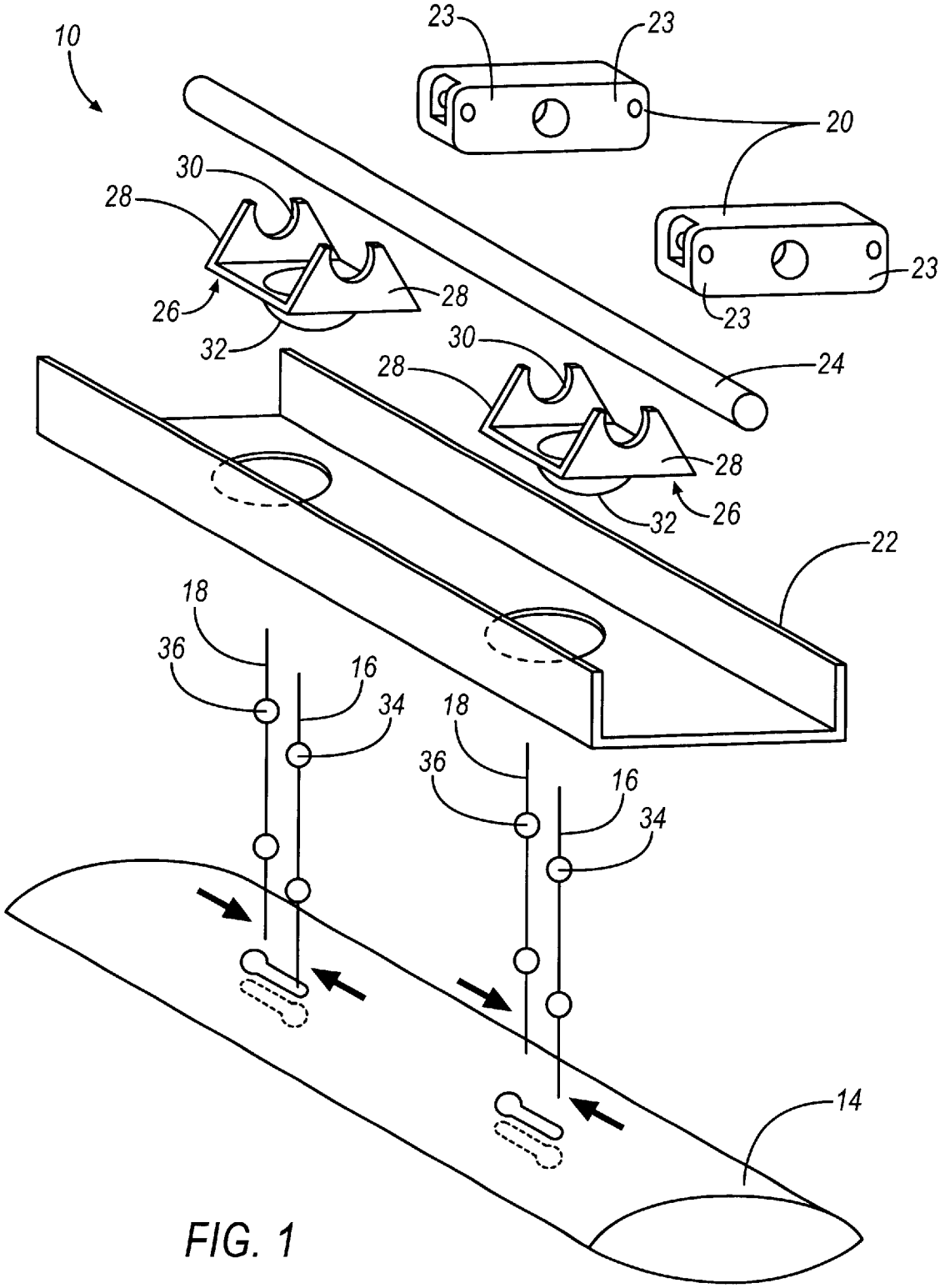
FIG. 1 is an exploded perspective view showing an actuator device according to the principles of the present invention.

In order to achieve the collapsibility and expandability of cells 14, actuation device 12 employs at least one cooperating pair of control members that are engaged with cells 14 along a plane parallel to the plane of the window covering. In the embodiment illustrated in FIGS. 1–3, the control members include a cooperating pair of cords, i.e., a first cord 16 and a second cord 18. As illustrated in FIG. 1, it is contemplated that a plurality of cord pairs could be disposed along the length of cells 14, the number of pairs employed generally depending on the width of window covering 10. At their upper extreme, cords 16 and 18 are secured to an actuator mechanism that is housed in a head-rail 22. In the embodiment illustrated in FIG. 13, the actuator mechanism is a rotatable member 20 that preferably includes a pair of integrally formed arms 23 to which cords 16, 18 are attached, but is not intended to be limited thereto. As will be described in further detail below, rotatable member 20 can be rotated in a direction that causes first cord 16 to move upward and second cord 18 to simultaneously move downward, and vice versa.

Actuator device 12 may include a plurality of rotatable members 20 corresponding in number to the number of cord pairs positioned along the width of window covering 10. Each rotatable member 20 is mounted on an axle 24, which in turn is supported by a plurality of cradles 26 that are positioned along the length of axle 24 proximate each rotatable member 20. As illustrated in FIG. 1, each cradle 26 is preferably a U-shaped structure defining a pair of spaced apart arms 28 each having a notch 30 that is sized to receive axle 24. Once assembled, each rotatable member 20 is disposed on axle 24 substantially between arms 28. Alternatively, rotatable member 20 may be provided to one side (i.e., cantilevered) relative to the two arms 28, or only one arm 28 may be employed per cradle 26, with the plurality of cradles 26 providing the required stability of axle 24.

Referring still to FIG. 1, each cradle 26 preferably includes a guide portion 32 that is disposed in an opening in head-rail 22. As will be described in detail below, guide portion 32 functions to re-position cords 16 and 18 from the fore-and-aft spacing at the connection with rotatable member 20 to a side-by-side spacing substantially parallel with the plane of window covering 10.

It will be appreciated that the means of moving cords 16, 18 is not limited to rotatable members 20, and that other actuator mechanisms may be employed in head-rail 22 (none illustrated). For example, the actuator mechanism may include a cylindrical drum upon which cords 16, 18 are collected. In another example, the actuator mechanism may include pair of push rods within head-rail 22 to which cords 16, 18 are connected. The push rods are moveable along the length of head-rail 22 to move cords 16, 18 in opposing directions. A conventional rack-and-pinion arrangement could be provided to regulate movement of the push rods and a rotatable wand or control rod could be employed to rotate the pinion. In yet another example, rotatable members 20 may be mounted in head-rail 22 parallel with cells 14 such that no twisting of cords 16, 18 is necessary between cells 14 and rotatable member 20. A multi-axle drive mechanism would be required to drive rotation of the rotatable members 20 since, in this embodiment, rotatable members 20 would not share a common pivot axis.

Referring again to FIGS. 2 and 3, in order to adjust the shape of each cell 14, first cord 16 is adapted too support the lower portion of each cell 14 and second cord 18 is adapted to support the upper portion of each cell 14. By raising and lowering first cord 16 and second cord 18, each cell 14 can be expanded (see FIG. 3) or collapsed (see FIG. 2).

To support the lower portion of each cell 14, first cord 16 includes a plurality of elements 34 positioned along its length. Elements 34 are preferably spaced equally apart, such as in a bead chain, and each element 34 is adapted to abut an outer surface of the lower portion of a corresponding cell 14. When first cord 16 is raised, each element 34 presses upwardly against and "lifts" the lower portion of its associated cell 14. This lifting action results in the collapsing of each cell 14, as illustrated in FIG. 2. Collapse of each cell 14 is further facilitated by the lowering of cord 18 (as described below), which occurs simultaneously with the raising of cord 16 due to the pivotal movement of rotatable member 20. In the fully expanded condition of each cell 14 (as shown in FIG. 3), elements 34 drop through an enlarged aperture in the next lower cell, so as not to interfere with the desired face-to-face contact between adjacent cells 14 in the fully closed or view-blocking condition of cells 14.

Figure 4:
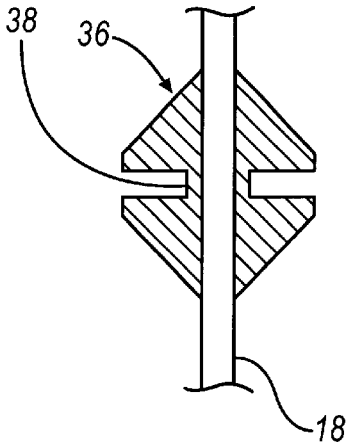
FIG. 4 is a cross-sectional view of a cord element and cord for use in expanding and collapsing the cells of the window covering of FIGS. 2 and 3.
Figure 5:
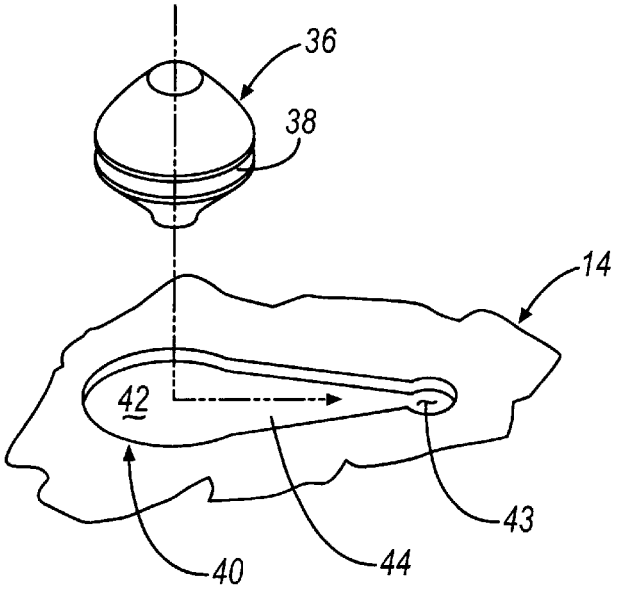
FIG. 5 is perspective view showing the cord element of FIG. 4 relative to an opening in a cell.

Similarly, second cord 18 includes a plurality of elements 36 positioned along its length. Each element 36 serves the function of providing support to the upper portion of a corresponding cell 14. As illustrated in FIGS. 4 and 5, elements 36 are preferably formed like small spools having a slot 38 that is slightly larger than the wall thickness of a mating cell 14. The outer surfaces of elements 36 are preferably conical to facilitate entry into an opening 40 in cell 14. The above-described structure of element 36 is not intended to be limited thereto, but may include other configurations such as clips, knots, loops and the like.

Referring to FIG. 5, opening 40 includes a first portion 42 that is large enough for elements 36 to be inserted into, and a second smaller portion 43 separated from first portion 42 by a tapered channel 44. Connecting elements 36 to cells 14 is accomplished by inserting element 36 into first portion 42 of opening 40 and subsequently sliding element 36 into second portion 43. Although not required, connecting elements 36 with the upper portion of each cell 14 at portions 43 advantageously reduces the tendency of cells 14 to flutter when collapsed or nearly collapsed.

As illustrated in FIG. 2, each element 36 is used to support each cell 14 from the upper portion thereof. Therefore, when second cord 18 is raised along its longitudinal axis, each engaged element 36 supports each cell 14 from the upper portion thereof, wherein each cell 14 tends to "hang" from its engaged element 36. By raising cord 18, each cell 14 is suspended from its upper portion, while the simultaneous lowering of cord 16 and associated elements 34 allows the lower portion to move downwardly, resulting in the expansion of cells 14.

Because the operative plane of cooperating cords 16 and 18 is substantially parallel with the plane of window covering 10, the expansion of cells 14 is effected by the relative raising of second cord 18 and lowering of first cord 16 without significant fore-and-aft rotation or tilting of any cell 14 (as opposed to the case of intended tilting in conventional venetian blinds). In achieving the collapsibility and expandability of cells 14, it is essential that the ratio of the stiffness of each cell juncture to the weight of each cell 14 be selected so as to facilitate cell expandability and collapsibility. More specifically, the stiffness to weight ratio should be such that when the cells are supported from the upper portion, the weight of each cell 14 is sufficient to facilitate the opening of the cell, and when cells 14 are supported from the lower portion, the stiffness of each cell is low enough to facilitate the collapsing of the cell. Accordingly, expansion of cells 14 is gravity-driven, requiring that cord 16 regulate the expansion of cells 14, not force it.

Figure 6:
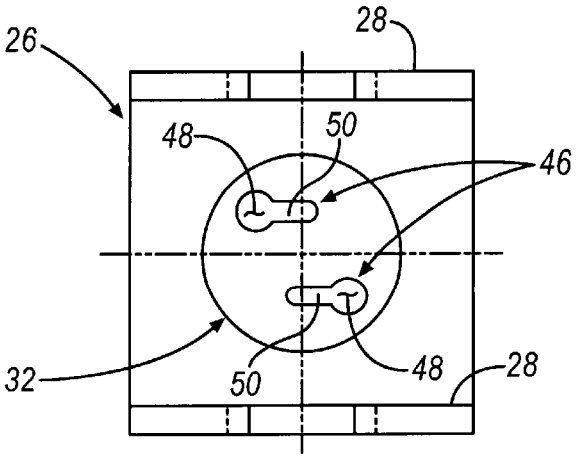
FIG. 6 is a top view of a cradle and guide according to the present invention.

Referring to FIG. 6, guide portion 32 of cradle 26 preferably includes a pair of passages 46, each having a first region 48 large enough to allow passage of elements 34, 36 and a second region 50 that allows passage of cords 16 and 18, but not elements 34, 36. Second regions 50 are aligned in the operative plane of cords 16, 18 so that cords 16, 18 remain aligned in their operating location. Cords 16 and 18 extend up though guide portion 32 and are twisted from a plane substantially parallel with the plane of window covering 10 to a relative position substantially perpendicular to the window covering plane, wherein cords 16, 18 are attached to rotatable member 20. The attachment of cords 16, 18 to the ends of rotatable member 20 can be made in any of several known manners, including but not limited to, tying and crimping cords 16, 18 to a pair of posts 51 on rotatable member 20.

The upper and lower surfaces of each cell 14 remain substantially equidistantly spaced from the cell's central plane A—A with equal and opposite movement of cords 16 and 18. However, unequal movement of cords 16, 18 undesirably causes the cells to lift and fall as a whole rather than a balanced expansion or collapse of each cell 14. Unequal movement of cords 16, 18 is typically due to a relatively large change in the angle of cords 16, 18 relative to guide portion 32 as rotatable member 20 rotates.

To limit the angular change of cords 16, 18 relative to guide portion 32, the distance between posts 51 on rotatable member 20 is preferably not less than about twice the distance between elements 34 and 36 in a single cell 14 when cells 14 are collapsed. In the embodiment of FIG. 2, the suggested distance restricts the rotation angle of rotatable member 20 to less than about thirty degrees above and below horizontal for full actuation of cells 14 between the expanded and collapsed positions. Additionally, the axis of rotatable member 20 should be raised above guide portion 32 not less than approximately one-half the distance between posts 51 or approximately the distance between elements 34 and 36 in a single cell 14 when cells 14 are collapsed. Such a restriction limits the angular change of cords 16, 18 relative to guide portion 32 as rotatable member 20 rotates.

Any conventional means may be employed to rotate axle 24, e.g., a vertically rotatable wand or control rod, a slide stick or an electric motor (none shown). Additionally, as desirable in most window covering applications, a means of raising and lowering window covering 10 may be employed. One means of raising and lowering window covering 10 utilizes lift cords, which are separate from cords 16 and 18, to lift a bottom rail (neither shown) and cells 14 therebetween. The lift cords pass up through cells 14 and into head-rail 22 where they are wound around a turning guide that brings the lift cords into alignment within the head-rail. The lift cords pass through a cord lock in the head-rail and are tied together at a pull handle that is selectively operated to raise the bottom rail and cells 14.

Alternatively, the lift cords may be accumulated on and paid-out from axle 24 by fitting each rotatable member 20 with a slip clutch. In this embodiment, rotation of axle 24 in either direction initially rotates each rotatable member 20 to its limit. Thereafter, continued rotation of axle 24 causes each clutch to slip allowing the lift cord to be accumulated on or paid-out from axle 24 while rotatable member 20 is prevented from further rotation. This embodiment allows actuator device 10 and the means for raising and lowering window covering 10 to be controlled by a single user interface, such as a loop cord, rotatable wand and the like.

Figure 8:
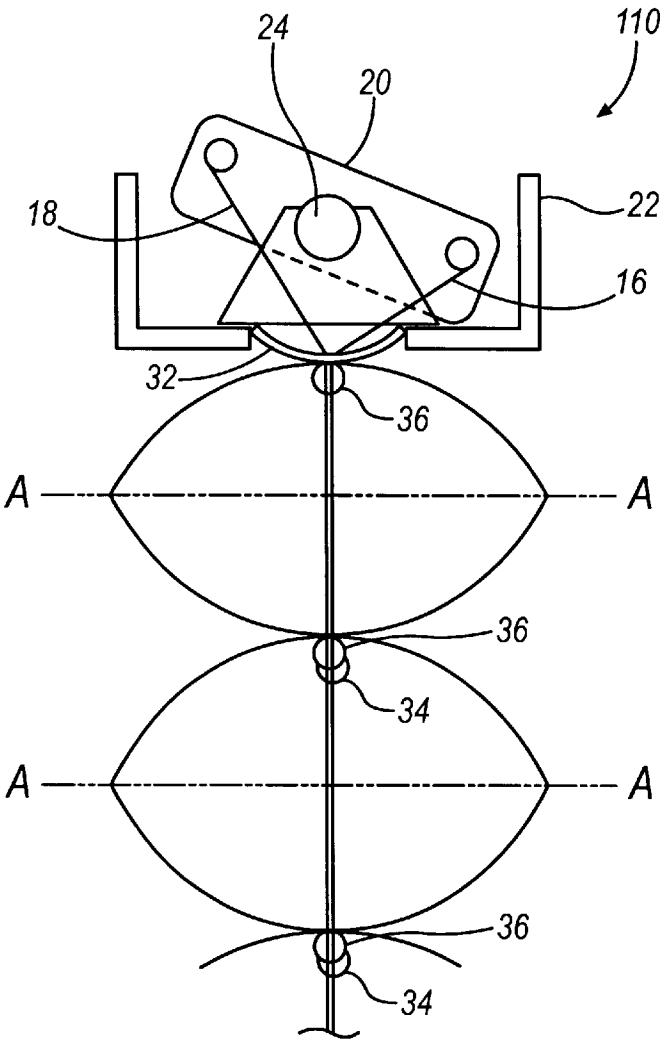
FIG. 8 is a side view of the window covering of FIG. 7, wherein the cells are arranged in a closed (expanded) position.
Figure 7:
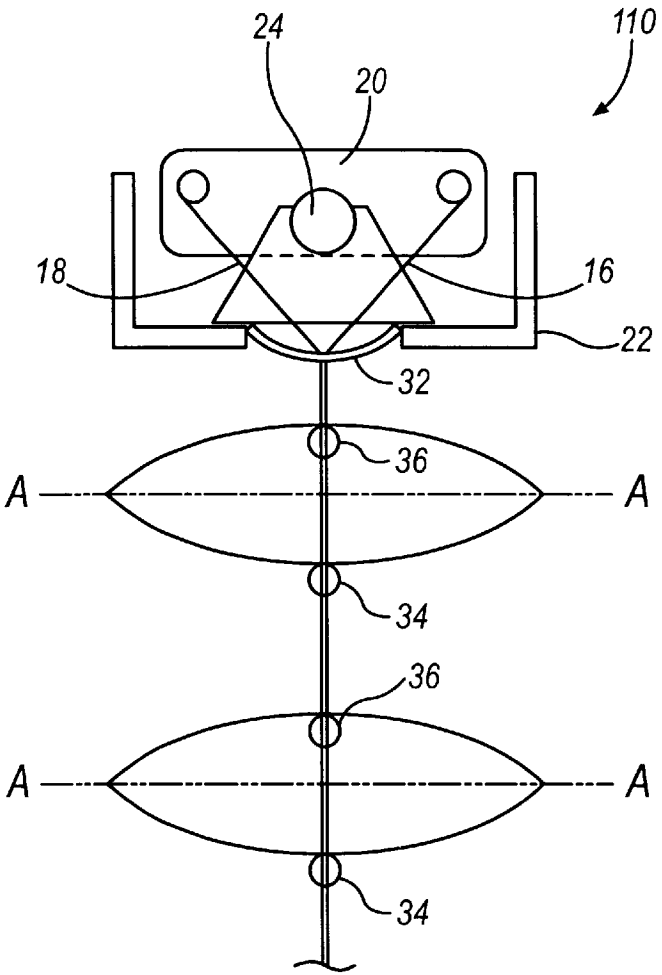
FIG. 7 is a side view of a window covering employing another embodiment of the actuator device of the present invention, wherein a plurality of cells are arranged in an open (collapsed) position.

Referring to FIGS. 7 and 8, another embodiment of the present invention is shown in detail. In this embodiment, a window covering 110 is disclosed that is substantially similar to window covering 10 with at least one exception, namely, elements 36 are not connected with cells 14. Instead, elements 36 abut the upper portion of cells 14 from underneath similar to the manner in which elements 34 abut the lower portion of cells 14. Supporting the upper portion of cell 14 in this manner eliminates the need to individually connect elements 36 with cells 14 during manufacture. In another embodiment of the present invention (not illustrated), elements 34 and 36 are both connected to the lower and upper portions of cells 14, respectively, in a manner substantially similar to that described above.

Figure 10:
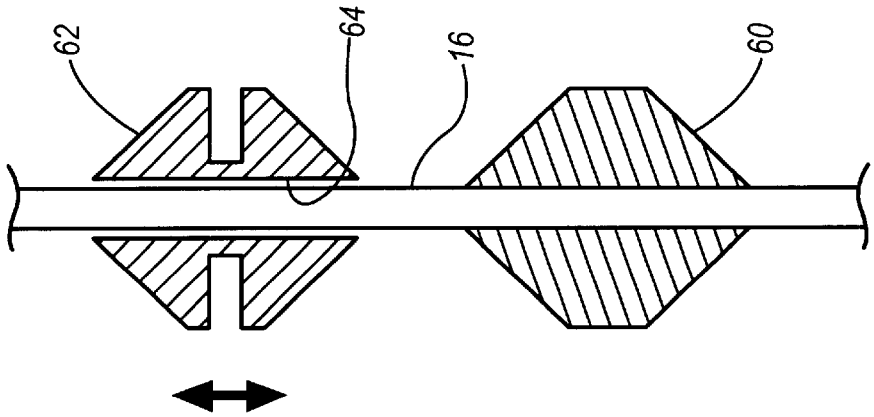
FIG. 10 is a cross-sectional view of a sliding cord element, fixed cord element and cord for use in expanding and collapsing the cells of the window covering of FIG. 9.
Figure 9:
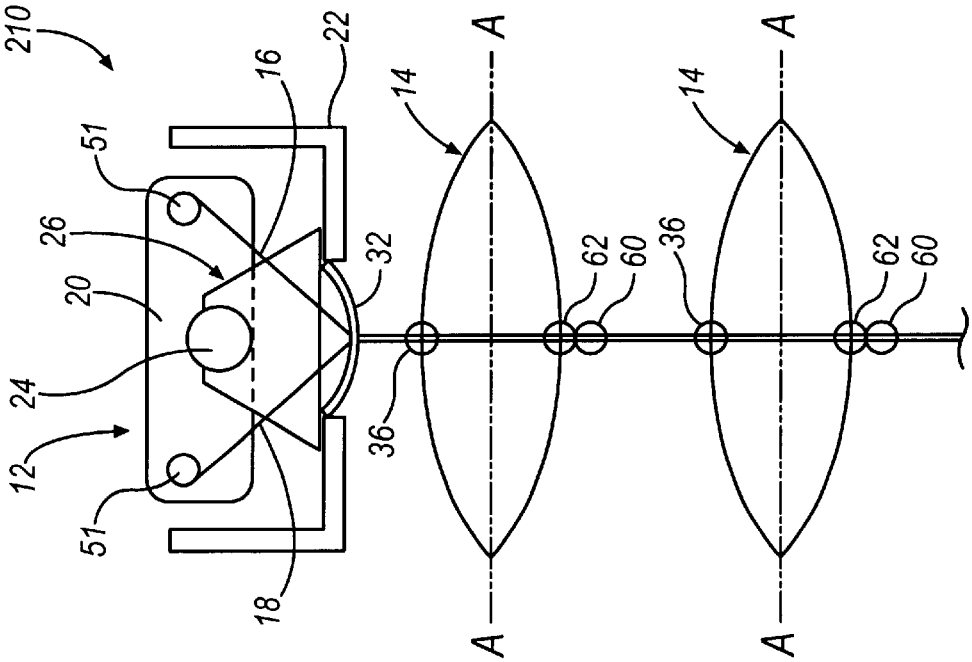
FIG. 9 is a side view of a window covering employing another embodiment of the actuator device of the present invention, wherein a plurality of cells are arranged in an open (collapsed) position.

Referring to FIG. 9, another embodiment of the present invention is shown in detail. In this embodiment, a window covering 210 is disclosed that is substantially similar to window covering 10 with at least one exception, namely, first cord 16 includes two elements per cell 14 instead of the one element 34 described above. More specifically, for each cell 14, first cord 16 includes a fixed element 60 and a sliding element 62. As illustrated in FIG. 10, sliding element 62, which is substantially similar in structure to element 36 described above, includes an interior channel 64 that is slightly larger in diameter than the diameter of cord 16. Interior channel 64 allows sliding element 62 to slide freely on cord 16, while remaining aligned with the orientation of cord 16.

Sliding element 62 may be made by separately manufacturing two discrete halves and attaching the halves together around cord 16. Alternatively, sliding element 62 may be molded onto cord 16 at the same time fixed elements 60 are molded around cord 16. In this manner, a thin tubular member (not shown) is temporarily inserted between cord 16 and sliding member 62 during the molding operation. The tubular member is removed after sliding member 62 is molded around cord 16 to create interior channel 64.

Like element 36 described above with respect to cord 18, sliding element 62 is connected to its mating cell 14. In contrast, fixed element 60 is affixed to cord 16 and supports sliding element 62, which rests on top of fixed element 60 unless otherwise disturbed. In this manner, the lower surface of each cell 14 is indirectly supported and laterally guided, but not vertically positioned by fixed element 60 during closure. While sliding elements 62 provide no vertical positioning of cells 14, each sliding element 62 functions to resist tilt and flutter of its mating cell 14. Thus, a third cord (not illustrated) may be used to guide sliding elements 62, instead of using cord 16 to guide both sliding elements 62 and move fixed elements 60. The upper surface of each cell 14 preferably remains fully engaged with element 36, to provide uniform cell spacing and flutter resistance.

Figure 11:
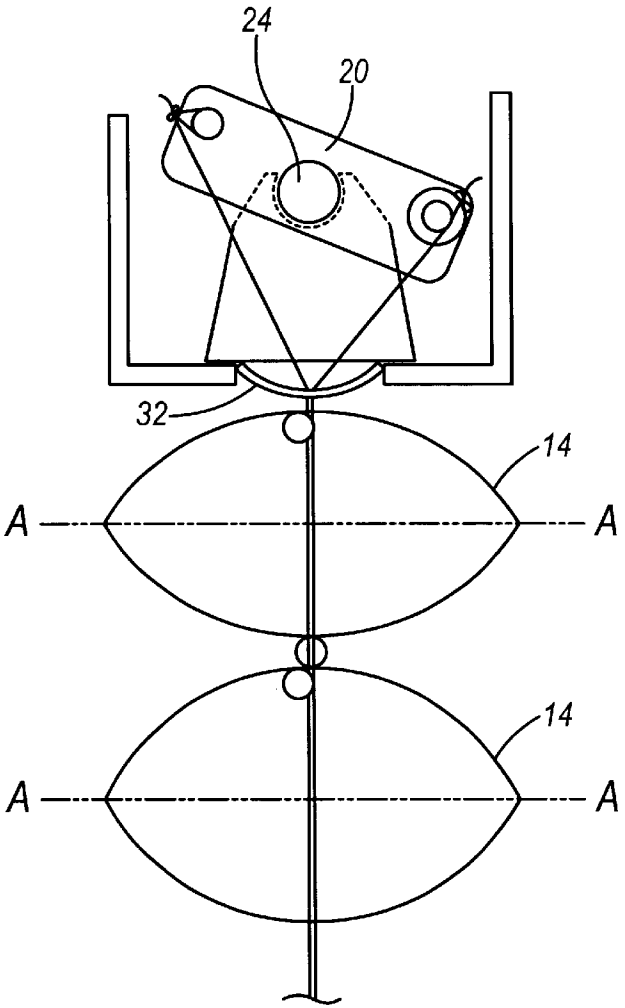
FIG. 11 is a side view of a window covering employing another embodiment of the actuator device of the present invention, wherein a plurality of cells are arranged in a closed (expanded) position.

Referring to FIG. 11, another embodiment of the present invention is shown in detail. In this embodiment, the axis of rotatable member 20 is raised above guide portion 32 a distance significantly greater than the spacing between elements 34 and 36 in a single cell 14 when cells 14 are collapsed. In this embodiment, the angle of cords 34 and 36 relative to guide portion 32 is reduced as compared to the embodiment illustrated in FIGS. 2 and 3, resulting in a smaller angular change in cords 16, 18 relative to guide portion 32 as rotatable member 20 rotates.

Figure 12:
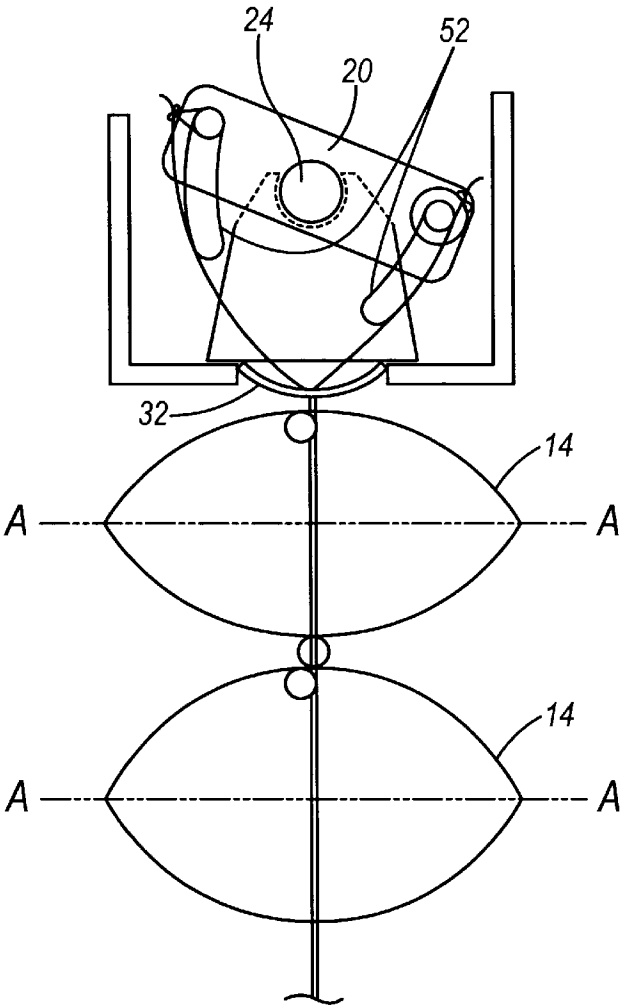
FIG. 12 is a side view of a window covering employing another embodiment of the actuator device of the present invention, wherein a plurality of cells are arranged in a closed (expanded) position.

Referring to FIG. 12, another embodiment of the present invention is shown in detail. In this embodiment, rotatable member 20 includes a pair of arc-shaped cam members 52. Cam members 52 arc about the center of rotation of rotatable member 20 so that rotation of rotatable member 20 does not substantially change the angle of cords 16, 18 relative to guide portion 32.

Although certain preferred embodiments of the present invention have been described, the invention is not limited to the illustrations described and shown herein, which are deemed to be merely illustrative of the best modes of carrying out the invention. A person of ordinary skill in the art will realize that certain modifications and variations will come within the teachings of this invention and that such variations and modifications are within its spirit and the scope as defined by the claims.

What is claimed is:

1. An actuator device for a window covering having a plurality of cells, comprising:

at least one cooperating pair of control members including a first control member that engages an upper portion of each cell and a second control member that engages a lower portion of each cell, the cooperating pair of control members being engaged with the cells along a plane substantially parallel to the plane of the window covering, whereby relative movement of the control members modifies the size of the space between the cells; and an actuator mechanism that is selectively operable to create substantially opposite movement in the vertical direction of the first and second control members, the first and second control members connected to the actuator mechanism in a plane substantially perpendicular to the window covering plane.

2. The actuator device of claim 1, wherein the first and second control members each comprise a cord having a plurality of cell-engaging elements spaced along their length.

3. The actuator device of claim 2, wherein one of the cell-engaging elements is positioned below a lower portion of each cell to selectively lift the lower portion of the cell to a collapsed position.

4. The actuator device of claim 3, wherein the cell-engaging element directly engages the lower portion of the cell.

5. The actuator device of claim 3, wherein the cell-engaging element positioned below the lower portion of each cell engages and lifts a mating element connected to the lower portion of the cell.

6. The actuator device of claim 2, wherein one of the cell-engaging elements is positioned immediately below an upper portion of each cell to abut the inner surface thereof to selectively lift the upper portion to an expanded position.

7. The actuator device of claim 2, wherein one of the cell-engaging elements is connected to the upper portion of each cell to selectively lift the upper portion to an expanded position.

8. The actuator device of claim 2, wherein one of the cell-engaging elements is connected to the lower portion of each cell to selectively push the lower portion to an expanded position.

9. The actuator device of claim 2, wherein at least one of the cell-engaging elements comprises a bead having opposing conical surfaces and a slot for receiving a portion of the cell.

10. The actuator device of claim 1, wherein the actuator mechanism is configured to minimize unequal opposite movement of the control members.

11. The actuator device of claim 1, further including a guide member positioned to transition the first and second control members from being aligned substantially perpendicular to the window covering plane to being aligned substantially parallel with the window covering plane.

12. An actuator device for a window covering having a plurality of cells, comprising:

at least one cooperating pair of control members including a first control member that engages an upper portion of each cell and a second control member that engages a lower portion of each cell, the cooperating pair of control members being engaged with the cells along a plane substantially parallel to the plane of the window covering, whereby relative movement of the control members modifies the size of the space between the cells;

an actuator mechanism that is selectively operable to create substantially opposite movement of the first and second control members; and a guide member positioned to transition the first and second control members from being aligned substantially perpendicular to the window covering plane to being aligned substantially parallel with the window covering plane.

13. An actuator device for a window covering having a plurality of cells, comprising:

at least one cooperating pair of control members including a first control member that engages an upper portion of each cell and a second control member that engages a lower portion of each cell, the cooperating pair of control members being engaged with the cells along a plane substantially parallel to the plane of the window covering, whereby relative movement of the control members modifies the size of the space between the cells; and wherein the first and second control members each comprise a cord having a plurality of cell-engaging elements spaced along its length, one of the cell-engaging elements being positioned below a lower portion of each cell to selectively lift the lower portion of the cell to a collapsed position, and wherein the cell-engaging element positioned below the lower portion of each cell engages and lifts a mating element connected to the lower portion of the cell.

14. The actuator device of claim 13, wherein the mating element is removably inserted into an opening in the lower portion of each cell.

15. The actuator device of claim 14, wherein the opening includes a first portion that is large enough for the mating element to be inserted into and a second smaller portion separated from the first portion by a channel.

16. The actuator device of claim 13, wherein at least one of the cell-engaging elements comprises a bead having opposing conical surfaces and a slot for receiving a portion of the cell.

17. The actuator device of claim 13, further including an actuator mechanism that is selectively operable to create substantially opposite movement in the vertical direction of the first and second control members.

18. The actuator device of claim 17, wherein the first and second control members are connected to the actuator mechanism in a plane substantially perpendicular to the window covering plane.

19. The actuator device of claim 17, wherein the actuator mechanism is configured to minimize unequal opposite movement of the control members.

20. The actuator device of claim 13, further including a guide member positioned to transition the first and second control members from being aligned substantially perpendicular to the window covering plane to being aligned substantially parallel with the window covering plane.

21. The actuator device of claim 13, wherein the mating element is free to slide on the cords and the cell-engaging element is fixed to the cords.

22. An actuator device for a window covering having a plurality of cells, comprising:

at least one cooperating pair of control members including a first control member that engages an upper portion of each cell and a second control member that engages a lower portion of each cell, the cooperating pair of control members being engaged with the cells along a plane substantially parallel to the plane of the window covering, whereby relative movement of the control members modifies the size of the space between the cells; and wherein the first and second control members each comprise a cord having a plurality of cell-engaging elements spaced along its length, at least one of the cell-engaging elements comprising a bead having opposing conical surfaces and a slot for receiving a portion of the cell.

23. The actuator device of claim 22, further including an actuator mechanism that is selectively operable to create substantially opposite movement in the vertical direction of the first and second control members.

24. The actuator device of claim 23, wherein the first and second control members are connected to the actuator mechanism in a plane substantially perpendicular to the window covering plane.

25. The actuator device of claim 23, wherein the actuator mechanism is configured to minimize unequal opposite movement of the control members.

26. The actuator device of claim 22, further including a guide member positioned to transition the first and second control members from being aligned substantially perpendicular to the window covering plane to being aligned substantially parallel with the window covering plane.

27. An actuator device for a window covering having a plurality of cells, comprising:

at least one cooperating pair of control members including a first control member that engages an upper portion of each cell and a second control member that engages a lower portion of each cell, the cooperating pair of control members being engaged with the cells along a plane substantially parallel to the plane of the window covering, whereby relative movement of the control members modifies the size of the space between the cells; and a guide member positioned to transition the first and second control members from being aligned substantially perpendicular to the window covering plane to being aligned substantially parallel with the window covering plane.

28. The actuator device of claim 27, further including an actuator mechanism that is selectively operable to create substantially opposite movement in the vertical direction of the first and second control members.

29. The actuator device of claim 28, wherein the actuator mechanism includes a rotatable member connected to the control members and a cradle for supporting the rotatable member.

30. The actuator device of claim 29, wherein the cradle includes the guide member.

31. The actuator device of claim 29, wherein the rotatable member includes a pair of arc shaped cam members.

32. The actuator device of claim 28, wherein the first and second control members are connected to the actuator mechanism in a plane substantially perpendicular to the window covering plane.

33. An actuator device for a window covering having a plurality of cells, comprising:

at least one cooperating pair of control members including a first control member that engages an upper portion of each cell and a second control member that engages a lower portion of each cell, the first and second control members each including a cord having a plurality of cell-engaging elements spaced along its length, wherein one of the cell-engaging elements is connected to the upper portion of each cell to selectively lift the upper portion to an expanded position, the cell-engaging element being removably inserted into an opening in the upper portion of each cell, the cooperating pair of control members being engaged with the cells along a plane substantially parallel to the plane of the window covering, whereby relative movement of the control members modifies the size of the space between the cells.

34. The actuator device of claim 33, wherein one of the cell-engaging elements is connected to the lower portion of each cell to selectively push the lower portion to an expanded position, the cell-engaging element being removably inserted into an opening in the lower portion of each cell.

35. The actuator device of claim 33, wherein the opening includes a first portion that is large enough for the cell-engaging elements to be inserted into and a second smaller portion separated from the first portion by a channel.

36. The actuator device of claim 33, wherein at least one of the cell-engaging elements comprises a bead having opposing conical surfaces and a slot for receiving a portion of the cell.

37. The actuator device of claim 33, further including an actuator mechanism that is selectively operable to create substantially opposite movement in the vertical direction of the first and second control members.

38. The actuator device of claim 37, wherein the first and second control members are connected to the actuator mechanism in a plane substantially perpendicular to the window covering plane.

39. The actuator device of claim 37, wherein the actuator mechanism is configured to minimize unequal opposite movement of the control members.

40. The actuator device of claim 33, further including a guide member positioned to transition the first and second control members from being aligned substantially perpendicular to the window covering plane to being aligned substantially parallel with the window covering plane.

41. The actuator device of claim 8, wherein the opening includes a first portion that is large enough for the cell-engaging elements to be inserted into and a second smaller portion separated from the first portion by a channel.

42. The actuator device of claim 11, wherein the control members include a cord and a cell-engaging element and the guide member includes a pair of passages having a first region large enough to allow passage of the cell-engaging element and a second region that allows passage of the cord, but not the cell-engaging element.

* * * * *